US005490306A

United States Patent [19]

Floyd et al.

[11] Patent Number: 5,490,306

[45] Date of Patent: Feb. 13, 1996

[54] HINGE AND SECURITY COVER PLATE ASSEMBLY

[76] Inventors: Ted Floyd, 453 Grand Ave., Spring Valley, Calif. 91977; Paul W. Hebert, 6450 Lake Shore Dr., San Diego, Calif. 92119

[21] Appl. No.: 233,253

[22] Filed: Apr. 26, 1994

[51] Int. Cl.[6] ..... E05D 11/00

[52] U.S. Cl. ..... 16/250; 16/251

[58] Field of Search ..... 16/250, 251, 380, 16/382, 387, 388

[56] References Cited

U.S. PATENT DOCUMENTS

| | | | |
|---|---|---|---|
| 1,683,272 | 9/1928 | Tucker | 16/250 |
| 1,754,013 | 4/1930 | Fisher | 16/380 |
| 2,102,290 | 12/1937 | Soss | 16/251 |
| 2,244,275 | 6/1941 | Ward et al. | 16/251 |
| 2,883,699 | 4/1959 | Gross | 16/387 |
| 3,422,486 | 1/1969 | Thomas, Jr. | 16/251 |
| 4,057,873 | 11/1977 | Bursani | 16/388 |

FOREIGN PATENT DOCUMENTS

| | | | |
|---|---|---|---|
| 2276417 | 9/1994 | United Kingdom | 16/380 |

*Primary Examiner*—P. Austin Bradley
*Assistant Examiner*—Chuck Y. Mah
*Attorney, Agent, or Firm*—Charles C. Logan, II

[57] ABSTRACT

A security cover plate assembly for a barrel hinge and the assembly has an inner cover plate and an outer cover plate. The inner cover plate has a flat wall portion and a curved wall portion. The outer cover plate has a flat wall portion and a curved wall portion and a top wall and a bottom wall extend from the respective top and bottom edges of its curved wall portion to cover its respective top and bottom ends. These top and bottom walls prevent access to the hinge pin of a conventional barrel hinge for a door, a window, a boat hatch, or any other installation when the security cover plate assembly plate has been installed in combination therewith. At least one pin extends transversely from the flat wall portion of one of the flat wall portions and the other of the flat wall portions has a pin receiving aperture. The transversely extending pins prevent removal of a door from its hinge assembly even if the hinge pin has been removed.

5 Claims, 2 Drawing Sheets

HINGE AND SECURITY COVER PLATE ASSEMBLY

BACKGROUND OF THE INVENTION

The invention relates to hinges and to a security cover plate assembly that would prevent the hinge pin of an installed barrel hinge from being removed therefrom.

Presently most doors are mounted by barrel hinges having a left plate member, a right plate member and a hinge pin. Usually one of the plate members has two longitudinally spaced barrel sleeves extending from its one edge while the other plate member has three barrel sleeves extending from its one edge. The spacing and height of the barrel sleeves is such that they interlock together to form a cylindrical sleeve for detachably receiving a hinge pin. When the door hinge is mounted to both a door jamb and a door so that the door can open in a specific direction, the aligned barrel sleeves are physically accessible from the side of the door toward which it may be opened. This allows a person to remove the hinge pins from each of the hinge assemblies and usually the door can be forcibly removed from its door jamb and access gained to the interior of the room or house.

It is an object of the invention to provide a novel security cover plate assembly for the barrel hinge of a door that will prevent a person from being able to gain access to the hinge pins of the door hinges.

It is also an object of the invention to provide a novel security cover plate assembly that can be retro fitted to existing barrel hinges for doors.

It is another object of the invention to provide a novel security cover plate assembly for the barrel hinge of a door that can be manufactured as original installation equipment.

It is a further object of the invention to provide a novel security cover plate assembly for the barrel hinge of a door that is economical to manufacture and market.

It is an additional object of the invention to provide a novel security cover plate assembly for the barrel hinge of a door that is easily and quickly installed or removed.

It is also an object of the invention to provide a novel security cover plate assembly that can be used with window hinges, boat hatch hinges and other hinges.

SUMMARY OF THE INVENTION

The novel security cover plate assembly for the barrel hinge of a door has been designed to prevent access to the hinge pins of conventional barrel hinges used for mounting doors. The security cover plate assembly has an inner cover plate and an outer cover plate.

The inner cover plate has a flat wall portion and a curved wall portion that is adjacent its right edge. The curved wall portion extends from the top edge of the flat wall portion to its bottom edge and it has a cross sectional configuration that is substantially circular but the curved wall portion would be no greater than 180 degrees of such a circle.

The outer cover plate has a flat wall portion and a curved wall portion adjacent its left edge. The curved wall portion extends from its top edge to its bottom edge and it has a curvature that is substantially circular but the curved wall portion would be no greater than 180 degrees of such a circle. A top wall having a circular configuration and a bottom wall having a circular configuration extend from the respective top and bottom edges of the outer cover plate to close the respective top and bottom ends of the curved wall portion.

The inner cover plate and the outer cover plate have a plurality of screw apertures that are positioned on their respective flat wall portions to align with the respective screw apertures of the left and right plate members of a conventional barrel hinge. At least one pin extends transversely from one of the flat wall portions of the respective inner cover or outer cover plate. The other of said flat wall portions of the inner cover plate or outer cover plate have a pin receiving aperture. When the door is in its closed position, the respective transversely extending pins will be engaged in their respective pin receiving apertures and even if the hinge pin has been removed from the barrel hinge, it will be impossible to remove the door from the door jamb.

The novel security cover plate assembly can be combined with a door barrel hinge structure so that it can be used for original installation. The novel security cover plate structure is incorporated into the structure of one of the plate members of a door barrel hinge.

The novel security cover plate assembly can also be used with other hinges having structure similar to the barrel hinges for a door. Examples of some such hinges might be found on window hinges, boat hatch hinges and other applications.

DESCRIPTION OF THE PREFERRED EMBODIMENT

Figure 1:
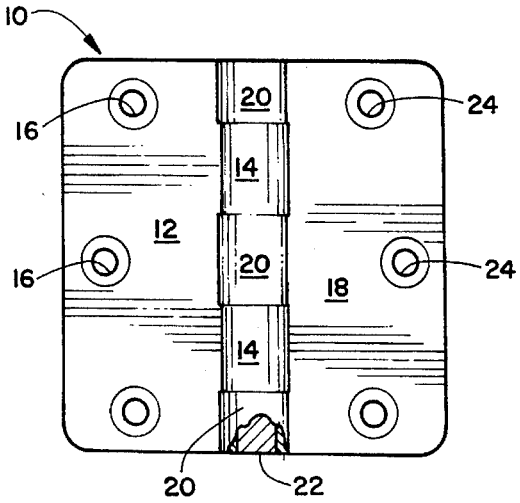
FIG. 1 is a front elevation view of a conventional barrel hinge used for mounting doors.

The novel security cover plate assembly will now be described by referring to FIGS. 1–8 of the drawings. FIG. 1 illustrates a conventional barrel hinge for a door and it is generally designated numeral 10. It has a left plate member 12 having a pair of barrel sleeves 14 formed adjacent its right edge. A plurality of screw apertures 16 are arranged in a predetermined pattern on the left plate member. The right plate member 18 has three vertically spaced barrel sleeves 20 that interlock with barrel sleeves 14 to form a sleeve for hinge pin 22. A plurality of screw apertures 24 are arranged in a predetermined pattern.

Figure 2:
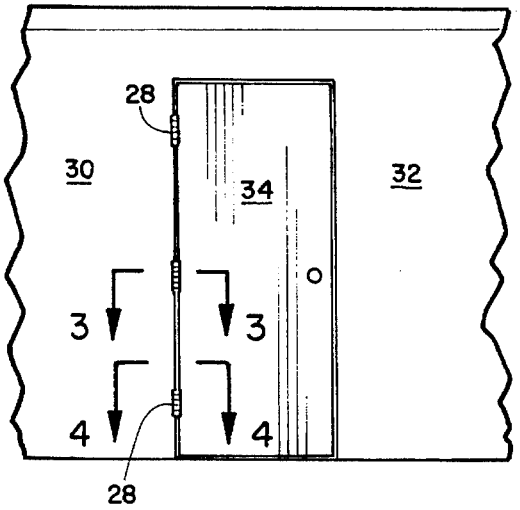
FIG. 2 is a front elevation view illustrating a plurality of the security cover plate assemblies installed on the conventional barrel hinge assemblies.

The novel security cover plate assembly is best illustrated and described by referring to FIGS. 2–5 of the drawing. In FIG. 2 the conventional barrel hinges 10 are hidden from view by the novel security cover plate assemblies 28. FIG. 2 shows a wall 30, a wall 32 and a door 34.

Figure 3:
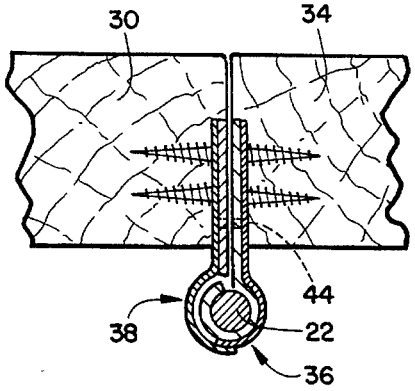
FIG. 3 is cross sectional view taken along lines 3—3 of FIG. 2.
Figure 4:
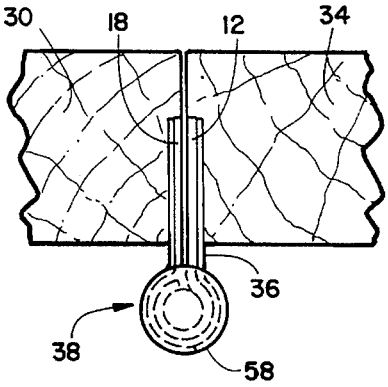
FIG. 4 is a cross sectional view taken along lines 4—4 of FIG. 2.
Figure 5:
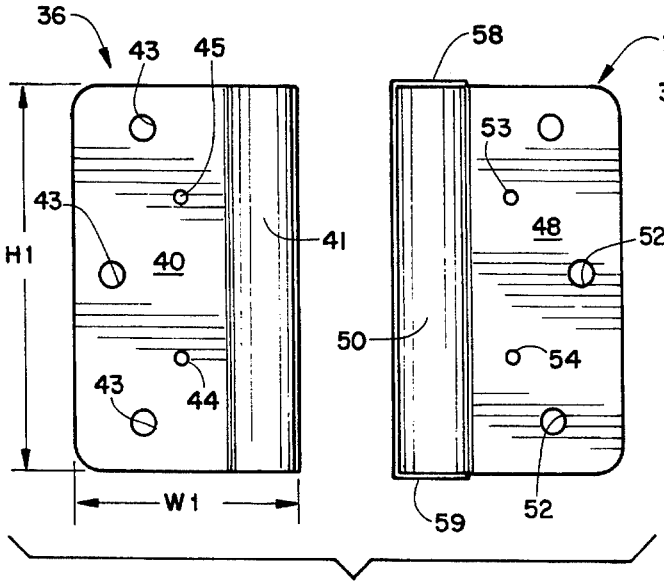
FIG. 5 is a front elevation view of the inner cover plate and outer cover plate of the novel security cover plate assembly.
Figure 6:
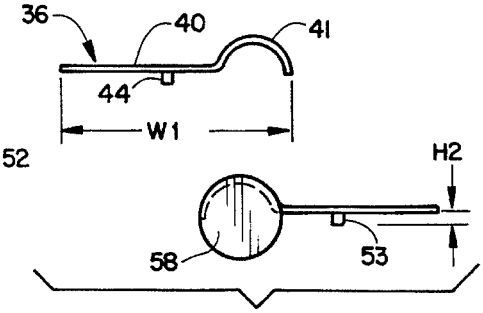
FIG. 6 is a top plan view of the inner and outer cover plates illustrated in FIG. 5.

The security cover plate assembly 28 has an inner cover plate 36 and an outer cover plate 38 and they each have a predetermined height H1 and a predetermined width W1. Inner cover plate 36 has a flat wall portion 40 and a curved wall portion 41. Flat wall portion 40 also has a plurality of screw apertures 43, a transversely extending pin 44 and an alignment aperture 45. Outer cover plate 38 has a flat wall portion 48 and a curved wall portion 50. Outer cover plate 38 also has a plurality of screw apertures 52, a transversely extending pin 53 and an alignment aperture 54. The respective pins 44 and 53 have a predetermined height H2 and they are aligned with the respective alignment apertures 45 and 54 so that when the door is closed the pins would be extending into their aligned apertures. Curved wall portion 50 has a circular top wall 58 and a circular bottom wall 59. FIGS. 3 and 4 show the security cover plate assembly in its installed position.

Figure 7:
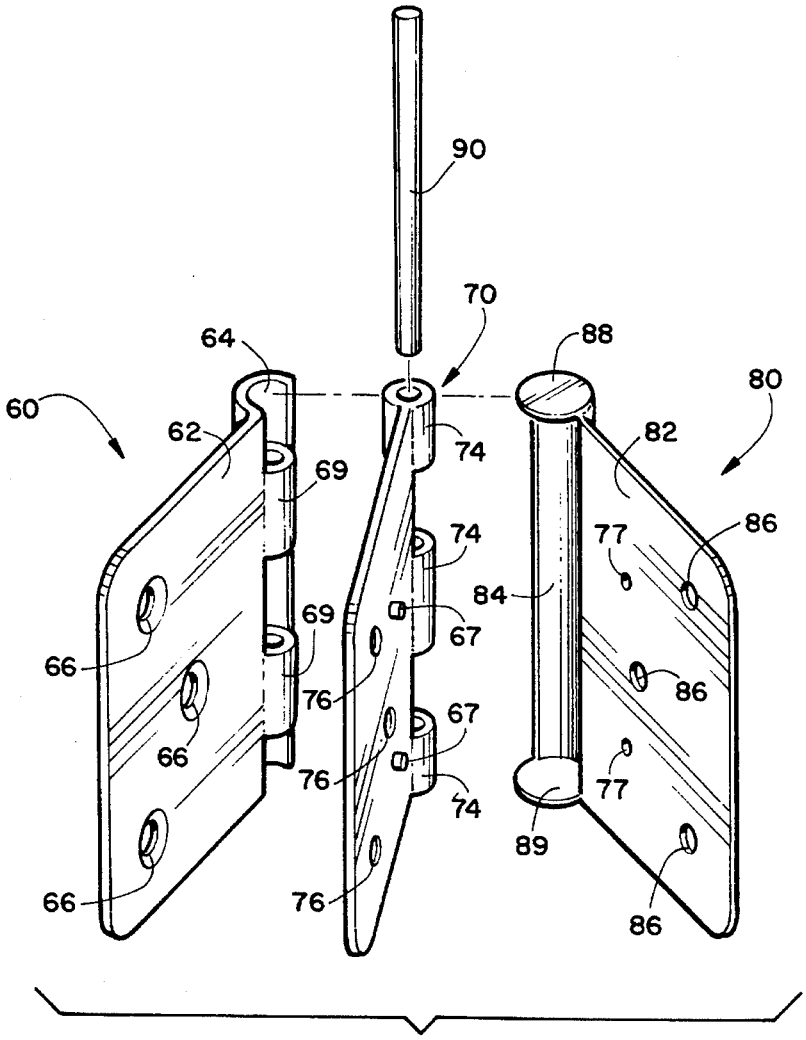
FIG. 7 is an exploded front perspective view of an embodiment that incorporates part of the novel security cover plate assembly into conventional barrel hinge structures for original installation.
Figure 8:
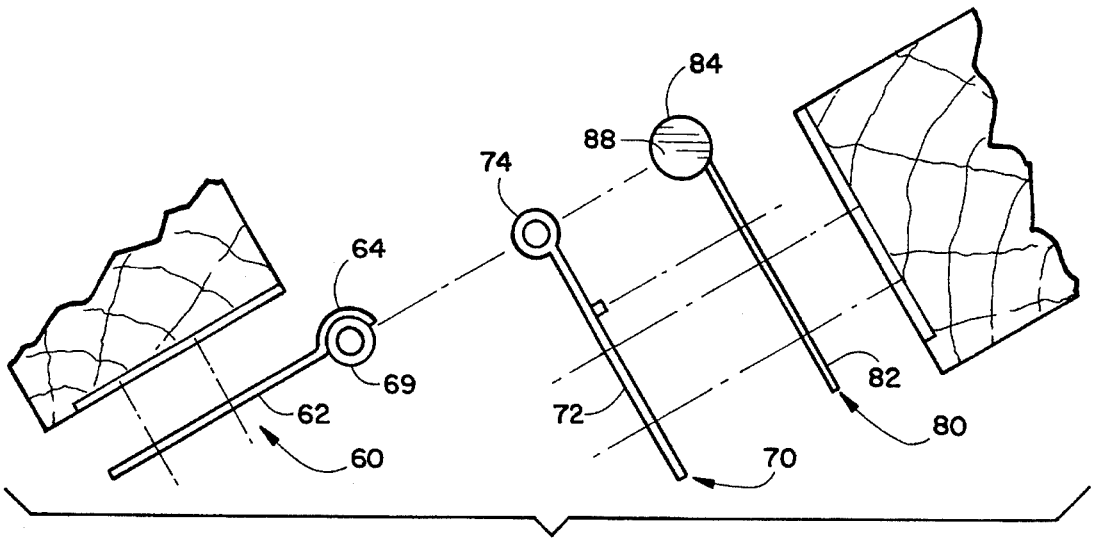
FIG. 8 is a top plan view of the three plate members illustrated in FIG. 7.

The embodiment having the novel cover plate structure incorporated into the structure of the plate member of a door barrel hinge is illustrated in FIGS. 7 and 8. It has an inner cover plate 60, a conventional cover plate member 70, an outer cover plate 80 and a pin 90. Inner cover plate 60 has a flat wall portion 62 and curved wall portion 64. Flat wall portion 62 also has a plurality of screw apertures 66, a transversely extending pin 67 and an alignment aperture 68. A pair of longitudinally spaced barrel sleeves 69 are formed on the inner surface of curved portion 64. The conventional plate member 70 has a flat wall portion 72 and a plurality of longitudinally spaced barrel sleeves 74. Flat wall portion 72 also has a plurality of screw apertures 43, a transversely extending pin 77 and an alignment aperture 78. Outer cover plate 80 has a flat wall portion 82 and a curved wall portion 84. Outer cover plate 80 also has a plurality of screw apertures 86. Curved wall portion 84 has a circular top wall 88 and a circular bottom wall 89.

What is claimed is:

1. A security cover plate assembly for a barrel hinge comprising:

an inner cover plate having a top edge, a bottom edge, a left edge, a right edge; said inner cover plate having a flat wall portion and a curved wall portion that is located at said right edge, said curved wall portion having a front surface, a plurality of screw apertures are formed in said flat wall portion at positions that would align with the screw apertures of conventional barrel hinges;

a plurality of longitudinally spaced barrel sleeves are located on the front surface of said curved wall portion;

a conventional plate member having a top edge, a bottom edge, a left edge, and a right edge; said conventional plate member having a flat wall portion, a plurality of longitudinally spaced barrel sleeves are formed on the left edge of said flat wall portion and they are detachably interlockable between the respective longitudinally spaced barrel sleeves on the front surface of the curved wall portion of said inner cover plate, a plurality of screw apertures are formed in said flat wall portion at positions that would align with the screw apertures of said inner cover plate; and an outer cover plate having a top edge, a bottom edge, a left edge and a right edge; said outer cover plate having a flat wall portion and a curved wall portion that is located at said left edge, a plurality of screw apertures are formed in said flat wall portion at positions that would align with the screw apertures of conventional barrel hinges; a top wall of a predetermined configuration extends from the top edge of said outer cover plate over the top end of said curved wall portion to prevent access to a barrel hinge pin, a bottom wall of a predetermined configuration extends from the bottom edge of the outer cover plate over the bottom end of said curved wall portion to prevent access to a barrel hinge pin.

2. A security cover plate assembly for a barrel hinge as recited in claim 1 further comprising at least one pin extending transversely from the flat wall portion of one of said flat wall portions and the other of said flat wall portions having a pin receiving aperture.

3. A security cover plate assembly for a barrel hinge as recited in claim 1 wherein said curved wall portions extend substantially from the top edges of said cover plates to their bottom edges.

4. A security cover plate assembly for a barrel hinge as recited in claim 1 wherein said curved wall portions form no more than 180 degrees of a circular arc.

5. A security cover plate assembly for a barrel hinge as recited in claim 1 wherein said top and bottom walls of said outer cover plate have a substantially circular configuration.

* * * * *